United States Patent [19]

Yamamoto et al.

[11] 4,357,526

[45] Nov. 2, 1982

[54] CERAMIC HEATER

[75] Inventors: Shigeyoshi Yamamoto; Nobukazu Sagawa; Noriyoshi Nakanishi, all of Kokubu, Japan

[73] Assignee: Kyoto Ceramic Kabushiki Kaisha, Kyoto, Japan

[21] Appl. No.: 298,580

[22] Filed: Sep. 2, 1981

Related U.S. Application Data

[63] Continuation of Ser. No. 133,602, Mar. 24, 1980, abandoned.

[30] Foreign Application Priority Data

Mar. 24, 1979 [JP] Japan ..... 54-34938

[51] Int. Cl.[3] ..... H05B 3/44

[52] U.S. Cl. ..... 219/544; 123/145 A; 219/270; 219/553; 361/266

[58] Field of Search ..... 219/216, 238, 267, 270, 219/345, 528, 535, 541, 543, 544, 552, 553; 123/145 R, 145 A; 361/264, 265, 266; 338/22 R, 22 SD; 431/262

[56] References Cited

U.S. PATENT DOCUMENTS

| | | | |
|---|---|---|---|
| 3,017,541 | 1/1962 | Lawser | 361/266 X |
| 3,569,787 | 3/1971 | Palmer | 219/270 |
| 4,035,613 | 7/1977 | Sagawa et al. | 219/552 |
| 4,192,989 | 3/1980 | Jeromin | 219/216 |

*Primary Examiner*—Volodymyr Y. Mayewsky
*Attorney, Agent, or Firm*—Spensley, Horn, Jubas & Lubitz

[57] ABSTRACT

This disclosure relates to a ceramic heater excellent in thermal shock resistance, high temperature resisting property, and free from change in resistance value even in the repeated use of the heater at high temperatures. The heater comprises a heat resisting element of high melting-point metal embedded in a ceramic body of nonoxide selected from a group consisting of silicon nitride, sialon, aluminium nitride and silicon carbide.

5 Claims, 5 Drawing Figures

CERAMIC HEATER

This is a continuation of application Ser. No. 133,602, filed Mar. 24, 1980, now abandoned.

BACKGROUND OF THE INVENTION

1. Field of the Invention

This invention relates to a ceramic heater having a heat resisting element embedded in a ceramic body of nonoxide.

2. Prior Art

In a conventional type ceramic heater, as shown in FIG. 1, a resistance heating pattern 3 of an optional shape such as a sinuous shape, spiral shape and of width and length is formed by a so-called thick film forming method such as screen printing by use of paste prepared by kneading manganesemolybdenum, molybdenum, tungsten or the like powder so that the opposing face of either of a pair of upper and lower substrates 1 and 2 of a ceramic green sheet made of alumina as a raw material may have a specified electric resistance value. The pair of upper and lower substrates 1 and 2 are laminated so as to form welded portions for lead wire terminals into a desired shape such as a flat plate or a cylindrical shape shown in FIG. 2 either by laying the upper and lower substrates 1 and 2 one over the other with the resistance heating pattern 3 sandwiched therebetween and cutting away the substrate 2 in part so that both terminal ends 3' (the other end not shown) of the resistance heating pattern 3 may be exposed, or by laying either one of the substrates 1 and 2 over the other in an offset relation, or by forming through holes in the substrate 2 after the substrates 1 and 2 have been laminated. Thereafter, the substrates 1 and 2 thus formed into the desired shape are sintered into one body in a reduced atmosphere of about 1600° C. The initial end 3' having the resistance heating pattern 3 exposed thereat and the terminal end portion not shown are plated with nickel and have lead terminals 4 fixed thereto by silver soldering. By energizing the terminals 4 with an electric current the heat resisting element embedded in the alumina ceramic is heated. The ceramic heater constructed in the manner described above finds application in all fields of industry.

But the ceramic heater having such a heating element embedded in the alumina ceramic body is not free from the disadvantage of being low in thermal shock resistance, and for example, heaters each having the resistance heating element embedded in a plate-shaped alumina ceramic body of a dimension of 30 mm long × 10 mm wide × 3 mm thick were energized and kept heated to various degrees of temperature and the heaters thus heated were immersed in the water of 25° C. to examine the temperature at which cracks were produced, only to find that all the ceramic heaters produced cracks in the yemperatures ranging from 200° to 240° C. such that they were impossible to use.

Also, a heater having a resistance heating element embedded in an alumina ceramic body formed into a cylinder 50 mm in diameter, the resistance heating element having tungsten paste printed thereon, was tested to see a rise time necessary for room temperature (20° C.) to be elevated to 800° C. (temperature in the highest temperature portions). The result of the test showed that cracks were produced in a rise time less than five seconds and that the heater made of alumina ceramic was weak in thermal shock resistance.

Furthermore, in alumina ceramic, mechanical strength at high temperatures, namely high temperature deflection strength is as small as 20–30 kg/mm$^2$ in the range of room temperature to 900° C., which is insufficient in strength at high temperatures. Also, the heater in which alumina ceramic was used was found unable to provide a ceramic heater having a stable high temperature heating characteristic as a result of the test conducted on the change in resistance value which the resistance heating element has undergone under the effect of time. The resistance heating element formed by the thick film forming method as above and embedded in the alumina ceramic was subjected to a repeated test in the manner that, after the element was maintained at a saturation temperature of higher than 1000° C. for about 30 seconds, power was off and after a lapse of 60 seconds the element was again heated to the saturation temperature. Examination of changes in the resistance value of the resistance heating element due to the effect of time by the repetition of tests showed that when the repetition of the above procedure 1500 times at a saturation temperature of 1000° C. was effected, the element increased about 10% in resistance value and that when the repetition was carried out 1500 times at a saturation temperature of 1100° C., the element increased about 20 to 30% in resistance value. In the manner described, because the resistance heating element changed in resistance value during its use as a heater, application of the same voltage effected a gradual decrease in heating value and could not provide a specified heating temperature.

SUMMARY OF THE INVENTION

This invention provides a ceramic heater excellent in thermal shock resistance and high temperature heating characteristic and which is free from change in resistance value even in repeated use at high temperatures and stable in heating characteristic.

A detailed description will now be given, by way of example, of the invention with reference to the accompanying drawing.

DETAILED DESCRIPTION OF THE PREFERRED EMBODIMENTS

Figure 1:
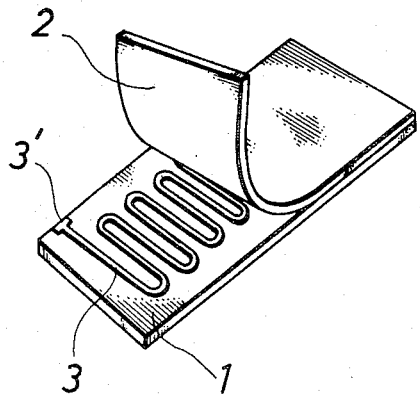
FIG. 1. (Prior Art)
FIG. 1 is a perspective view showing a conventional ceramic heater on the process of manufacture.
Figure 2:
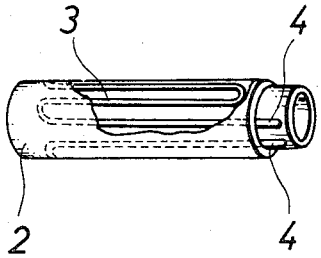
FIG. 2. (Prior Art)
FIG. 2 is a perspective view, broken in part, of a similar conventional alumina ceramic heater of a cylindrical shape.
Figure 3:
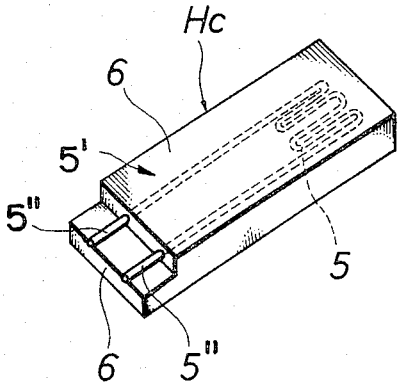
FIG. 3 is a perspective view of a silicon carbide plate-shaped heater according to the present invention.

Shown in FIG. 3 is a plate-shaped heater Hc pressure burnt by a pressure and heat method. According to the present invention, in forming silicon carbide (SiC) powder into a specified shape, a heating element 5' constructed in a sinuous shape of a filament 5 of tungsten (or molybdenum), which is one of high temperature melting-point metals that constitutes a resistance heating element, is disposed in a metal mold in a specified position and then the mold is filled with silicon carbide powder so as to be press formed and is thereafter heated to a temperature of about 2000° C. with the continued application of pressure. Stated from the point of configuration, the resistance heating element of tungsten filament 5 is embedded in the silicon carbide body with the initial and terminal ends of the filament 5 exposed to form a pair of electrode terminals 5, and energization of the element is effected at both ends of the element. Examples of characteristics of the ceramic heater Hc manufactured in this manner are shown in Tables 1 and 2.

Incidentally, in the heater Hc of a silicon carbide ceramic body having a volumetric dimension of 70 mm long×5 mm wide×3 mm thick is embedded a tungsten filament 0.2 mm in diameter having a resistance value of about 0.5Ω at normal temperature. Additionally, the measured temperatures all indicate the highest temperature portions of the heater and a test on repeated temperature rise was conducted at a saturation temperature of 1100° C. on application of a voltage of 13.0 v.

TABLE 1

| | Elevated temperature characteristic | |
|---|---|---|
| Applied voltage(v) | Rise time up to 800° C.(Sec) | Saturation temperature(°C.) |
| DC 14 | 4.5 | 1250 |
| 15 | 3.7 | 1290 |
| 16 | 3.4 | 1355 |
| 17 | 3.1 | 1380 |
| 18 | 2.9 | 1400 |

TABLE 2

| | Number of times repeated | | | |
|---|---|---|---|---|
| Sample | 0 cycle | 500 cycles | 1000 cycles | 1500 cycles |
| No. 1 | 0.551Ω | 0.549Ω | 0.553Ω | 0.550Ω |
| No. 2 | 0.531Ω | 0.531Ω | 0.534Ω | 0.529Ω |
| No. 3 | 0.502Ω | 0.505Ω | 0.500Ω | 0.504Ω |
| No. 4 | 0.493Ω | 0.491Ω | 0.495Ω | 0.492Ω |
| No. 5 | 0.485Ω | 0.487Ω | 0.486Ω | 0.485Ω |

As is apparent from Table 1, a rise time of temperature up to 800° C. on application of a voltage of 14–18 v DC was less than 4.5 seconds, and a saturation temperature also was enabled to be elevated to a high temperature of up to 1400° C. Also, a test on the repetition of temperature elevation at a saturation temperature of 1100° C. showed that there was no change in resistance value and that accordingly the heater is stabilized in performance.

A description will now be given of another form of heater embodying the present invention wherein a thin tungsten plate (or thin molybdenum plate) is embedded as a resistance heating element in a silicon nitride sintered body. First, referring to a method of manufacture, in shaping silicon nitride powder by a metal mold, the powder is formed into a desired shape so as to provide the formed body in a specified position with through holes each, for example, 1 mm in diameter, and thereafter the through holes 11 (FIG. 5) are filled with pasted tungsten powder and the same pasted tungsten powder as that with which the through holes are filled is applied to that portion in which the thin tungsten plate is joined to the through holes, and a resistance heating element 7 made of the thin tungsten plate etched thereon in a sinuous form as for example shown in FIG. 4 so as to provide the plate with a specified resistance value is sandwiched between two unsintered silicon nitride moldings and is burnt by hot pressing to obtain a silicon nitride ceramic heater Hn. The through hole portions are connected with the tungsten resistance heating element 7 embedded in the heater and are exposed at one end to the surface of a part of the sintered molding and are in a metallized state. By joining other conductors through electrodes to these two metallized portions. The portions are connected at one end to a metal sleeve 8 and at the other end to terminals 9. The two metallized surface portions are mounted with a metal fitting so as to provide a glow plug, which is adapted to be used for a sub-combustion chamber of a diesel engine.

The measured value of the characteristic of the silicon nitride ceramic heater Hn thus manufactured for use as a glow plug is shown in Tables 3 and 4. By the way, the temperaturesmeasured were all those of the highest temperature portions of the heater, and the saturation temperature in a test on repeated temperature rise was 1100° C. on application of a voltage of 13.0 v.

TABLE 3

| | Elevated temperature characteristic | |
|---|---|---|
| Applied voltage(v) | Rise time up to 800° C.(sec) | Saturation temperature(°C.) |
| DC 14 | 5.0 | 1230 |
| 15 | 4.5 | 1280 |
| 16 | 3.8 | 1346 |
| 17 | 3.4 | 1375 |
| 18 | 3.2 | 1400 |

TABLE 4

| | Number of times repeated | | | |
|---|---|---|---|---|
| Samples | 0 cycle | 500 cycles | 1000 cycles | 1500 cycles |
| No. 1 | 0.511Ω | 0.507Ω | 0.510Ω | 0.511Ω |
| No. 2 | 0.484Ω | 0.478Ω | 0.483Ω | 0.484Ω |
| No. 3 | 0.503Ω | 0.505Ω | 0.506Ω | 0.502Ω |
| No. 4 | 0.496Ω | 0.494Ω | 0.496Ω | 0.495Ω |
| No. 5 | 0.515Ω | 0.516Ω | 0.513Ω | 0.515Ω |

As apparent from Table 3, a rise time of temperature up to 800° C. on application of a voltage of 14–18 v DC was 5 seconds at the longest, and was 3.2 seconds on application of a voltage of 18 v DC, and it was possible to heat the heater and elevate the saturation temperature thereof also to a high temperature of 1400° C.

Because of the fact that a resistance heating element 7 made of a thin tungsten plate makes almost no change in resistance value even in a test on repeated temperature rise in a saturation temperature of 1100° C., it is apparent that even the repeated use of the heater made of such a thin tungsten plate embedded in a silicon nitride ceramic body 10 does not deprive the heater of a stable heating characteristic.

The silicon nitride ceramic 10 out of the nonoxide-based ceramic used in this manner was formed into a specified shape and the thermal shock resistance of the ceramic was examined by the same testing method as that used in the preceding alumina ceramic heater. The examination results obtained were that, when several plates each having a size of 30 mm long×10 mm wide×3 mm thick and formed of silicon nitride ceramic 10 were kept heated to a specified temperature and then were immersed in the water of 25° C. within 5 seconds, the temperature at which cracks were produced was in the range of 500° to 550° C. It was found that such a temperature of crack production was twice as high in thermal shock resistance as the temperature of crack production in alumina ceramic in the range of temperature of 200° to 240° C.

Figure 4:
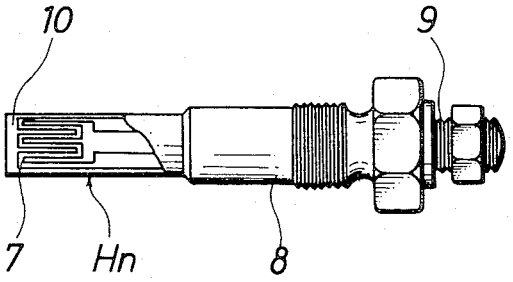
FIG. 4 is a perspective view, broken in part, of a glow plug to which a silicon nitride heater of the present invention is applied.
Figure 5:
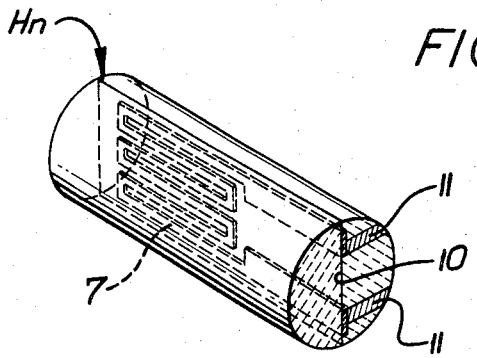
FIG. 5 is a perspective view of the heater portion of the slow plug shown in FIG. 4, showing the cross-sectional configuration of the heater.

Also, the results of testing conducted on the thermal shock property due to the heat build-up of a heater of a resistance heating element of tungsten embedded in the silicon nitride ceramic body 10 of the configuration shown in FIG. 4 showed that, when it took more than 3 seconds for the highest temperature portions of the heater to rise from room temperature (20° C.) to 800° C., no crack was produced and that cracks were produced only when it took less time (for example 2 seconds) for the heater to reach the preceding temperature.

But nevertheless, the silicon nitride ceramic heater was found superior in thermal shock property to the heater having alumina ceramic embedded therein in that when it took less than 5 seconds for the latter heater to reach a temperature of 800° C., cracks were produced in the heater.

Since in the invention the resistance heating element constructed, in a thin plate or a filament form, of a tungsten, molybdenum or the like high temperature melting-point metal is embedded in the ceramic body made of sintered silicon carbide, silicon nitride, etc., the invention provides a long-life, reliable ceramic heater which is excellent in thermal shock resistance and free from possible damage due to cracks even in the event of fuel dripping in a glow plug and which has a stable heater characteristic of being free from change in resistance value by repeated heating of the heater and free from production of cracks under the effect of heavy cold and heat cycles.

We claim:

1. A ceramic heater comprising a nonoxide ceramic material selected from the group consisting of silicon nitride, sialon, aluminum nitride and silicon carbide, wherein said ceramic material is formed into an integral body by the application of pressure and heat, said heater having a thin discrete heating element embedded in said ceramic, said heat generating element having exposed electrical terminals, said heat generating element being formed of high temperature melting-point metal having a main component selected from the group consisting of tungsten and molybdenum.

2. A ceramic heater according to claim 1 wherein said ceramic is formed into one body by hot pressing silicon carbide powder.

3. A ceramic heater according to claim 1 wherein said ceramic material is formed of silicon nitride powder and said heating element is selected from the group consisting of a tungsten filament and an etched thin tungsten plate.

4. A ceramic heater according to claim 1 in combination with a glow plug, wherein said heating element is connected to the end of the glow plug through said terminals.

5. A ceramic heater comprising a nonoxide ceramic material selected from the group consisting of silicon nitride, sialon, aluminum nitride and silicon carbide, wherein said ceramic material is formed into an integral body, said heater having a thin discrete heating element embedded in said ceramic, said heat generating element having exposed electrical terminals, said heat generating element being formed of high temperature melting-point metal having a main component selected from the group consisting of tungsten and molybdenum.

* * * * *